US011002069B2

(12) United States Patent
Dekker et al.

(10) Patent No.: US 11,002,069 B2
(45) Date of Patent: May 11, 2021

(54) TILT ADJUSTER CONTROL MECHANISM FOR A VENETIAN BLIND

(71) Applicant: Hunter Douglas Industries B.V., Rotterdam (NL)

(72) Inventors: Nicolaas Dekker, Rotterdam (NL); Christianus Wilfred Michael Slobbe, Rotterdam (NL); David Peter Martin, Rotterdam (NL); Jan Pieter Wetsema, Rotterdam (NL)

(73) Assignee: HUNTER DOUGLAS INDUSTRIES B.V., Rotterdam (NL)

( * ) Notice: Subject to any disclaimer, the term of this patent is extended or adjusted under 35 U.S.C. 154(b) by 263 days.

(21) Appl. No.: 15/992,575

(22) Filed: May 30, 2018

(65) Prior Publication Data

US 2018/0347267 A1 Dec. 6, 2018

(30) Foreign Application Priority Data

Jun. 1, 2017 (EP) ..... 17174060

(51) Int. Cl.

| | |
|---|---|
| ***E06B 9/30*** | (2006.01) |
| ***E06B 9/32*** | (2006.01) |
| ***E06B 9/307*** | (2006.01) |
| ***E06B 9/322*** | (2006.01) |
| ***E06B 9/327*** | (2006.01) |
| *E06B 9/58* | (2006.01) |
| *E06B 9/303* | (2006.01) |

(52) U.S. Cl.

CPC ..... *E06B 9/307* (2013.01); *E06B 9/322* (2013.01); *E06B 9/327* (2013.01); *E06B 9/303* (2013.01); *E06B 2009/583* (2013.01)

(58) Field of Classification Search

CPC ..... E06B 9/307; E06B 9/322; E06B 9/327; E06B 2009/583; E06B 9/303

USPC ..... 160/368

See application file for complete search history.

(56) References Cited

U.S. PATENT DOCUMENTS

| | | | | |
|---|---|---|---|---|
| 3,795,266 | A * | 3/1974 | Debs | E06B 9/303 160/168.1 R |
| 4,762,159 | A * | 8/1988 | Ford | E06B 9/262 160/279 |
| 6,422,288 | B1 | 7/2002 | Dekker et al. | |
| 9,140,057 | B2 * | 9/2015 | Cheng | E06B 9/24 |
| 9,314,125 | B2 * | 4/2016 | Anthony | A47H 5/032 |
| 2004/0016513 | A1 * | 1/2004 | Hung | E06B 9/32 160/84.06 |
| 2006/0032160 | A1 * | 2/2006 | Gazaway | F41H 5/24 52/202 |

(Continued)

FOREIGN PATENT DOCUMENTS

| | | | | |
|---|---|---|---|---|
| CA | 2278944 | A1 * | 2/2000 | E06B 9/303 |
| DE | 10027771 | A1 * | 12/2001 | E06B 9/327 |

(Continued)

*Primary Examiner* — Jeanette E Chapman

(74) *Attorney, Agent, or Firm* — Dority & Manning, P.A.

(57) ABSTRACT

A Venetian blind to be fitted to an architectural frame, including a first rail; a second rail; and a transfer mechanism, wherein: the first rail includes a tilt controller configured to control tilting of the blind, the second rail includes a control actuator, and the transfer mechanism mechanically couples the control actuator and the tilt controller to transfer movement of the control actuator to the tilt controller.

20 Claims, 12 Drawing Sheets

(56) References Cited

U.S. PATENT DOCUMENTS

| | | | | |
|---|---|---|---|---|
| 2007/0023151 | A1* | 2/2007 | Judkins | E06B 9/322 160/170 |
| 2008/0142169 | A1* | 6/2008 | Dekker | E06B 9/327 160/188 |
| 2009/0173459 | A1* | 7/2009 | Hsu | E06B 9/322 160/331 |
| 2009/0256036 | A1* | 10/2009 | Wilson | E06B 9/323 248/201 |
| 2013/0299103 | A1* | 11/2013 | Anderson | E06B 9/322 160/331 |
| 2014/0069592 | A1* | 3/2014 | Hsu | E06B 9/26 160/84.05 |
| 2014/0216663 | A1* | 8/2014 | Lin | E06B 9/262 160/84.01 |
| 2018/0087318 | A1* | 3/2018 | Wen | E06B 9/327 |

FOREIGN PATENT DOCUMENTS

| | | | | |
|---|---|---|---|---|
| DE | 102012203945 | A1 * | 9/2013 | E06B 9/307 |
| DE | 202017105399 | U1 * | 12/2018 | E06B 9/322 |
| DE | 202017106793 | U1 * | 2/2019 | E06B 9/322 |
| EP | 2216484 | | 8/2010 | |
| EP | 2216484 | A1 * | 8/2010 | E06B 9/32 |
| EP | 2295702 | A2 * | 3/2011 | E06B 9/262 |

* cited by examiner

TILT ADJUSTER CONTROL MECHANISM FOR A VENETIAN BLIND

CROSS-REFERENCE TO RELATED APPLICATIONS

This application is based upon and claims priority to EP Patent Application No. 17174060.8, filed Jun. 1, 2017, the disclosure of which is hereby incorporated herein by reference in its entirety for ail purposes.

FIELD OF THE INVENTION

The following relates to a tilt adjuster control mechanism, in particular for a Venetian blind or other architectural coverings to be held in place with respect to an architectural frame, for example a window frame or a door frame.

BACKGROUND OF THE INVENTION

A Venetian blind is a shade including a plurality of slats or vanes, which can be tilted to an open or closed position to allow or prevent light to pass. These arrangements require a control mechanism to control the tilting of the shades. The term "Venetian blind" is used herein to refer to this type of slatted blinds of which the slats can be tilted. A Venetian blind is also commonly known as a "horizontal blind". For the sake of convenience, without intent to limit, the term "Venetian blind" will be used hereinafter.

EP 1,156,182 A describes a Venetian blind with slat tilting. The tilting of the slats is controlled by a cord loop which hangs from the top rail of the blind, connected to a tilt rod in the top rail, which controls an arrangement of ladder cords and tilt cords.

BRIEF DESCRIPTION OF THE INVENTION

As described herein, there is provided a Venetian blind to be fitted to an architectural frame, including a first rail; a second rail; and a transfer mechanism, wherein the first rail includes a tilt controller configured to control tilting of the blind; the second rail includes a control actuator; and the transfer mechanism mechanically couples the control actuator and the tilt controller to transfer movement of the control actuator to the tilt controller.

BRIEF DESCRIPTION OF THE DRAWINGS

Embodiments will be more clearly understood from the following description, given by way of example only, with reference to the accompanying drawings in which.

DETAILED DESCRIPTION OF THE INVENTION

Figure 1:
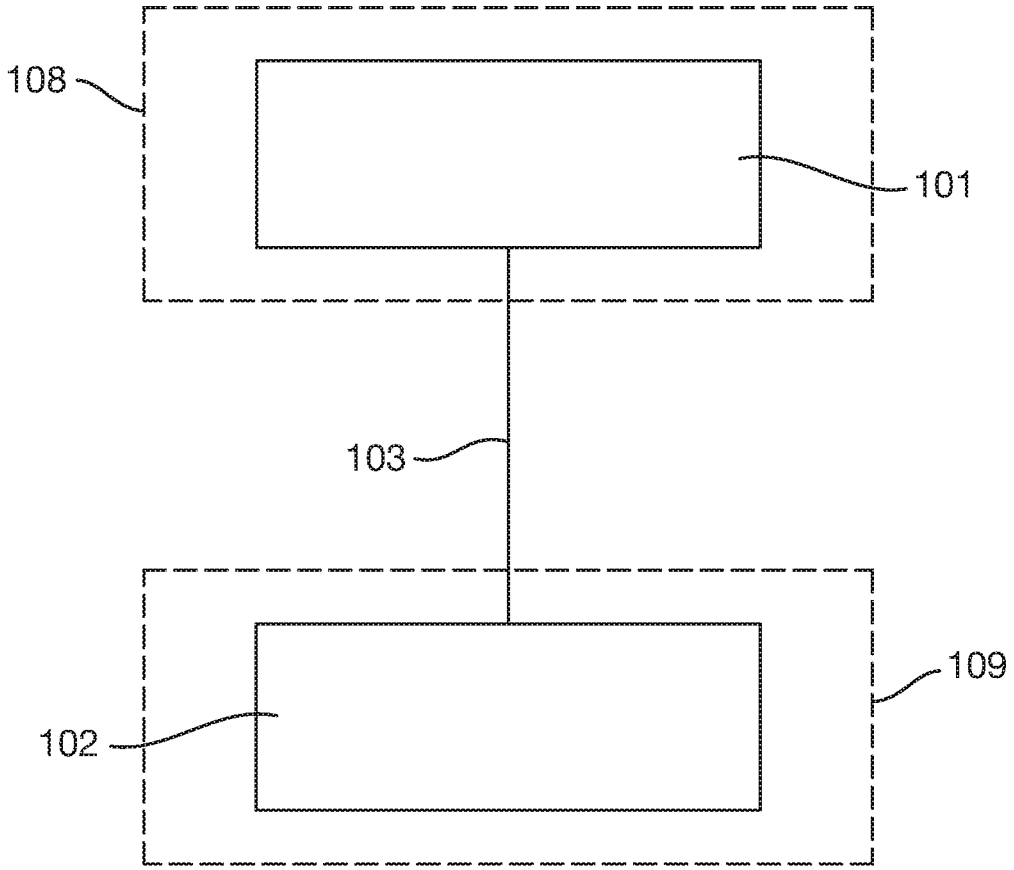
FIG. 1 illustrates a Venetian blind with a transfer mechanism.

The arrangement of control actuator, transfer mechanism and tilt controller as described herein may be applied to any type of Venetian blind known in the art. This means that the arrangement does not depend on the type of slats that are used, nor on the type of tilting mechanism, nor on the manner in which the blind is mounted to an architectural opening such as a window or door frame. For example, the Venetian blind may be a Venetian blind with moveable top and bottom rails mounted to an architectural opening using tensioning cords. EP 2 216 484 describes a so-called tensioned Venetian blind having movable top and bottom rails, and a pair of tension cords that generally secure the location of the Venetian blind. The two tension cords may be connected by top and bottom pairs of attachment members to top and bottom portions of a window. Each tension cord may pass into one side of each rail and out of the other side of the respective rail, so that the cords cross over inside both rails. The top rail and bottom rail can each be easily moved upwardly and downwardly along the tension cords to open and close the blind, and then are held in place by friction between the tension cords and openings in the rails, through which the tension cords pass.

A conventional Venetian blind typically includes a top rail from which a plurality of slats are suspended by means of at least two ladder cords. Each ladder cord typically includes a front and rear tilt cord and a plurality of cross rungs connecting the front and rear tilt cords forming the ladder. The slats are supported by the cross rungs. Venetian blind slats typically are elongate profiles having a generally rectangular shape which, when supported by the ladder cords, extend parallel to the head rail and have front and rear edges. The upper ends of the front and rear tilt cords are typically connected to a tilting mechanism. The tilting mechanism may be located in the head rail. Actuation of the tilting mechanism will lift one of the front or the rear tilt cords while lowering the other of the front and the rear tilt cords. This causes the orientation of the rung between the front and rear tilt cords to change angle. Since the slat is supported by the rungs, its orientation too will change, e.g. from front to rear edge the slat will be tilted at an angle. Thus the process of lifting/lowering the front and rear tilt cords by actuating the tilting mechanism is called tilting. Instead of cross-rungs, other means to support the slat are possible, such as connecting the slats to the front and rear tilt cords forgoing the need of the cross-rungs. The tilting process remains the same, i.e. lifting/lowering of the front and rear tilt cords causes the slats to tilt. The word "tilt cord" is used to describe an elongate flexible element which may be narrow in width, (e.g. a cord) or broader in width (e.g. a tape). The tilting may operate in the same manner with tilt cords or tilt tapes.

Having a tilting mechanism in a bottom rail would not work when the bottom rail is at an intermediate position between being fully extended and fully retracted, because when the blind is not fully extended the ladder cords are not taut along their whole length. In particular, in such an intermediate position a number of slats will rest on the bottom rail, these slats will be stacked one on the other and the front and rear tilt cords between these slats and the bottom rail will be slack thus making tilting impossible.

It is generally desirable to have a mechanism that can tilt the slats regardless of the extent to which the blind is raised or lowered. Typically the tilting mechanism is actuated by a user using a tilt control actuator. The tilt control actuator may be a wand, knob or cord on the head rail with a transfer mechanism which will transfer the movement of the actuator into movement of the tilting mechanism.

However, the head rail of a Venetian blind having the tilting mechanism and actuator may be inconvenient to operate for the user. For example, if the blind is mounted in a high window, or other similar opening, it may be difficult to access the tilt control actuator, or the implementation of the tilt control actuator may be cumbersome (e.g. a very long wand or cord).

It may therefore be desirable to operate tilting of the blind in a more convenient manner. Disclosed herein are arrangements which aim to at least partially address the above problem by a bottom rail including a control actuator and by a transfer mechanism which transfers movement of the control actuator from the bottom rail to a tilt controller included to a top rail and thus allows to tilt the slats at any position of the bottom rail. This can be thought of as the transmission of a "mechanical signal" from the control actuator to the tilt controller.

As described herein, there is provided a Venetian blind to be fitted to an architectural frame, including a first rail; a second rail; and a transfer mechanism, wherein the first rail includes a tilt controller configured to control tilting of the blind; the second rail includes a control actuator; and the transfer mechanism mechanically couples the control actuator and the tilt controller to transfer movement of the control actuator to the tilt controller.

This arrangement allows convenient access to the control actuator.

In the arrangement shown in FIG. 1, the tilt controller 101 is within the first rail 108. The first rail 108 is a top rail of a Venetian blind mounted at the top of an architectural frame. However, the tilt controller 101 may be mounted on the first rail 108 in a position outside the first rail.

The control actuator 102 is mounted in a second rail 109, which is a bottom rail of a Venetian blind.

Figure 7:
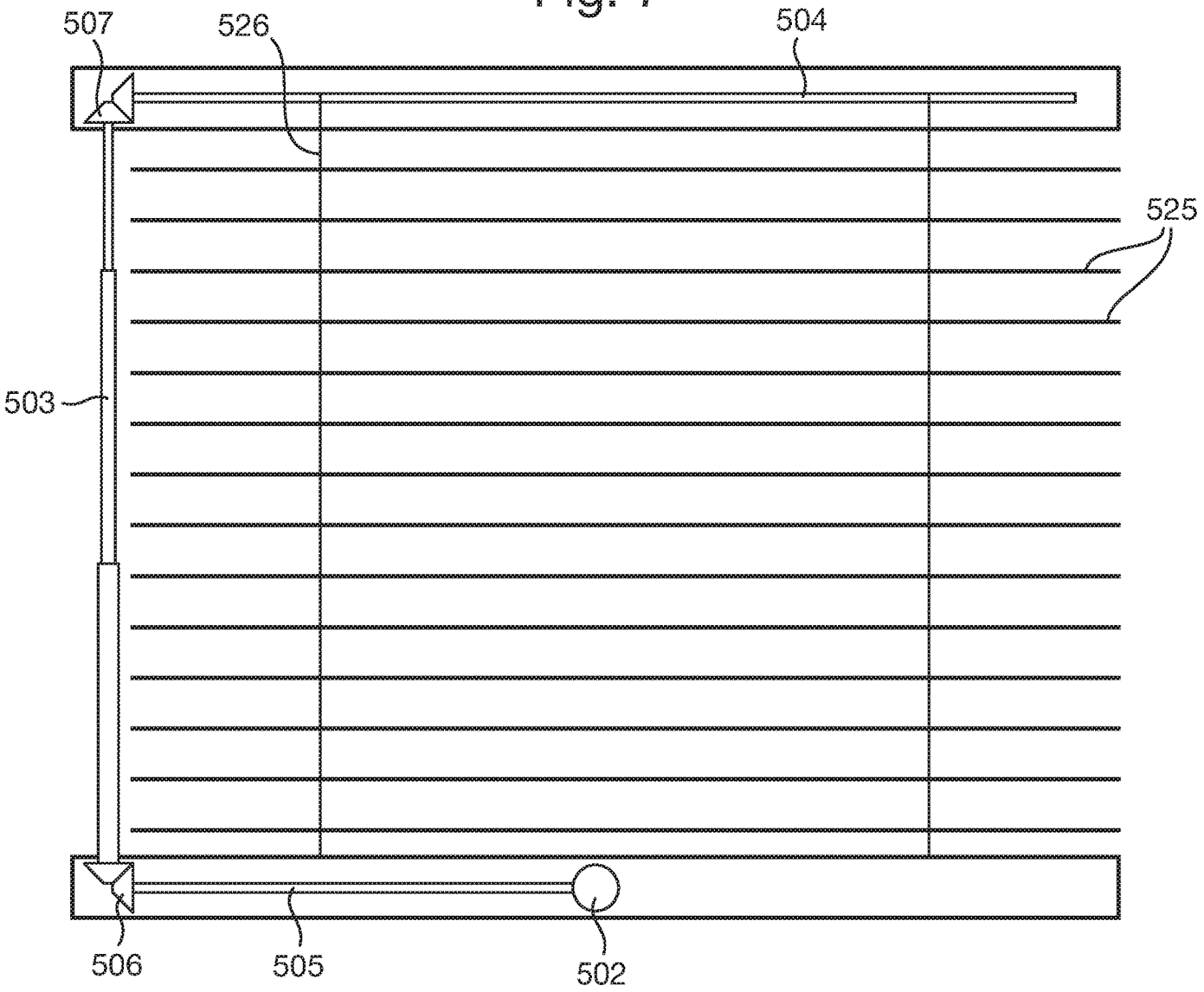
FIG. 7 illustrates a Venetian blind with a transfer mechanism with three rods.

The tilt controller 101 may be of any kind of tilting mechanism. Typical mechanisms for tilt controllers include an arrangement including a tilt drum (not shown in the figures) on a rotatable tilting shaft (a tilt shaft 504 is shown in FIG. 7) to which the front and rear tilt cords (front tilt cord 526 is shown in FIG. 7) are attached. Rotation of the tilting shaft over a given angle will rotate the tilt drum over same angle, which causes respective lifting and lowering of the respective front and rear tilt cords. The slats are either connected directly to the front and rear tilt cords, or rest on a rung spanning front and rear tilt cords. The movement of the tilt cords causes a tilting movement of the slats (shown as 525 in FIG. 7). Alternatively, a sliding tilting mechanism (best shown in FIGS. 2A-2C, 3 and 8) may be used, in which the front and rear tilt cords are connected to a slider, with a space between the front and rear tilt cords, wherein movement in the longitudinal direction of the top rail moves the front and rear tilt cords similarly as described above and thus tilts the slats. Specific arrangements of tilt controllers will be described below.

The transfer mechanism 103 mechanically couples the control actuator 102 and the tilt controller 101 to transfer movement of the control actuator 102 to the tilt controller 101. The mechanical coupling may be by means of cords, rods, metal tapes, or any other suitable mechanical coupling known in the art. Specific arrangements of transfer mechanisms will be described below.

The above arrangement renders operation of the tilt mechanism more convenient for the user. The provision of the control actuator in the second (i.e. bottom) rail means that the mechanism can be operated from a more convenient position, because the bottom rail is the lower rail, and thus may be easier to reach than the top rail.

In an arrangement, the Venetian blind may include a transfer portion extending between the first and second rails, wherein the transfer portion is configured such that movement of at least part of the transfer portion transfers movement of the control actuator to movement of the tilt controller.

Various arrangements of transfer portion extending between the first and second rails 108, 109 are possible. FIG. 1 shows the function of the transfer portion as transferring movement of the control actuator 102 to the tilt controller. The transfer portion may extend between one proximal end of the first rail and a corresponding proximal end of the second rail, between the middle of the first and second rails or between any other two points on the first and second rail, respectively. Suitable arrangements of transfer portion will be described in more detail below.

In an arrangement, the transfer mechanism includes a first transfer cord, configured such that the movement of the control actuator moves at least a part of the first transfer cord, which in turn moves the tilt controller.

Figure 2A:
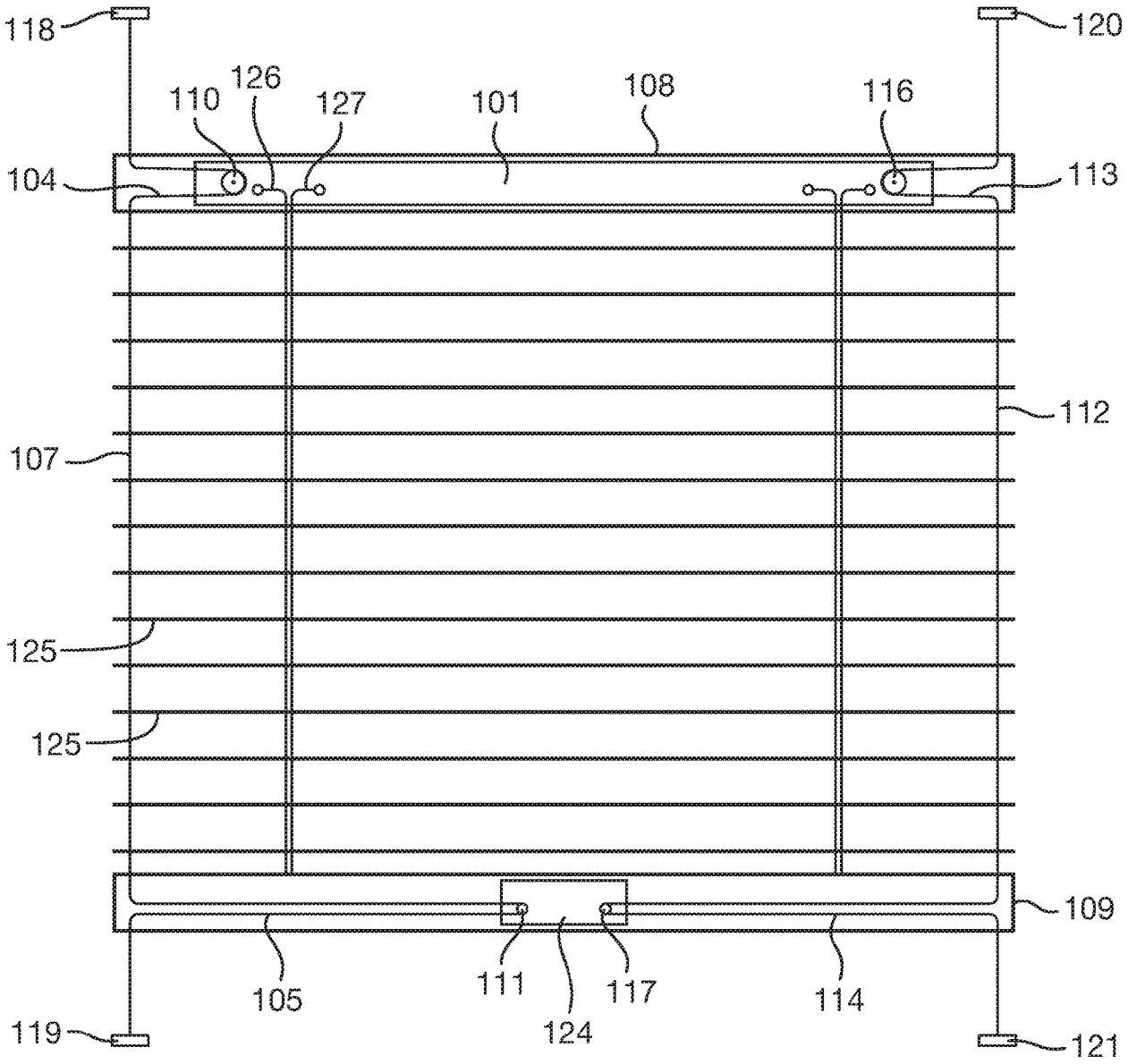
FIGS. 2A, 2B and 2C illustrate a Venetian blind with two transfer cords.
Figure 2B:
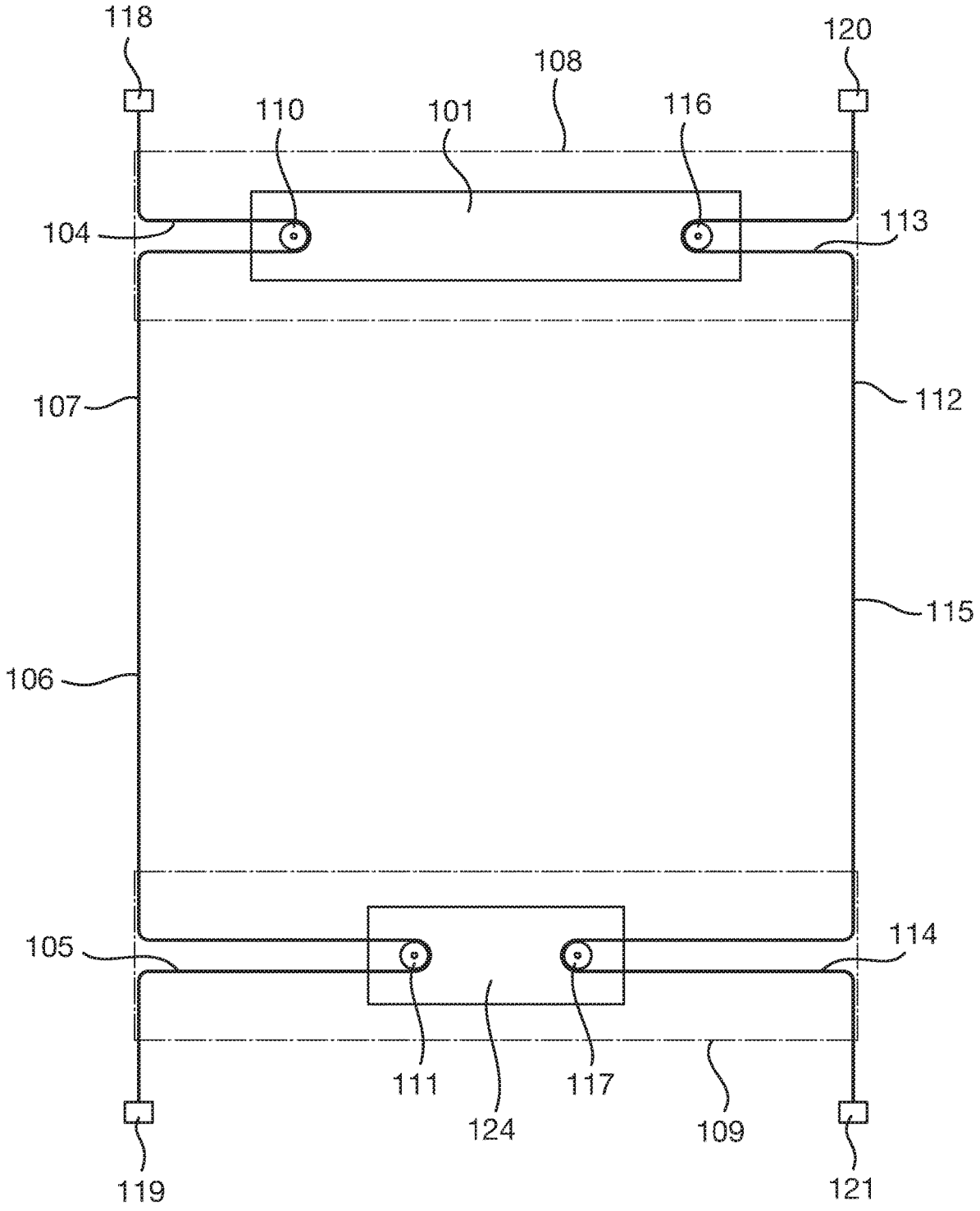
Figure 2C:
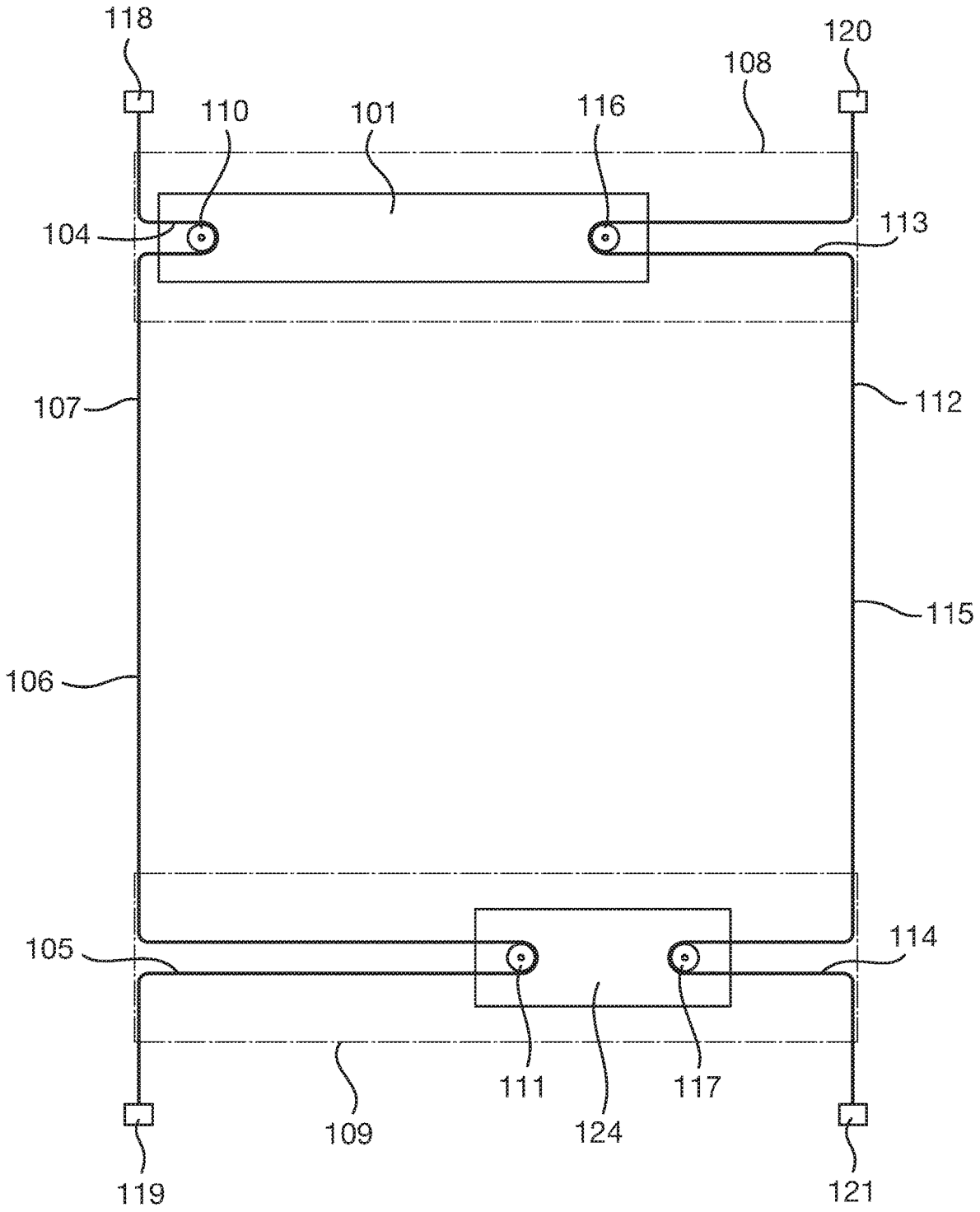

In the arrangement shown in FIGS. 2B and 2C, the control actuator 102 is shown in a first and a second position. In FIG. 2B the control actuator is shown in a first position in approximately the middle of the bottom rail 109. The arrangement of FIGS. 2B and 2C shows the transfer mechanism 103 as a single first transfer cord 107. That is, the first transfer cord 107 is shown as a continuous cord which runs between the tilt controller 101 and the control actuator 102.

Alternatively, the first transfer cord 107 may be made up of several lengths of cord joined together, which together form the first transfer cord 107.

When the control actuator is moved from the first position, as shown in FIG. 2B, to a second position, as shown in FIG. 2C, i.e. to the right when looking at the drawing, an axial force, or stress, is applied to the transfer cord, as is explained in further detail below. In other words, the tension in the cord increases. At the same time by the movement of actuator 102, pivot point 111 also moves and the loop 105 around pivot point 111 becomes larger. The increased tension in the cord overcomes the friction between the tilt controller and its mounting in the first rail. In the arrangement of FIGS. 2B and 2C, this means that in the head rail 108 the cord loop 104 about pivot point 110 becomes smaller, and the tilt controller 101 changes its position and moves to the left. Thus, the movement of the actuator 102, changes tension in the cord 107 which causes the tilt controller to move too but in opposite direction. This can be considered to be a "mechanical signal".

The provision of a transfer cord provides simplicity of operation, whereby movement of the control actuator 102 can be transferred to the tilt controller 101 using a single cord 107 which is easy and cheap to manufacture. Cords are easily replaceable and less likely to malfunction than a more complicated arrangement with multiple parts. However with a single cord, the controller when moving can act on the cord only in a single direction. The reverse direction may then be effected by other means (as is explained below).

The transfer mechanism may also include a flexible metal tape (similar to the type used in a measuring tape). This works similarly to a cord, with the tension in the tape transferring movement of the control actuator to movement of the tilt controller. In other words, the transfer cord may be a flexible metal tape. When a flexible metal tape is used, the stiffness of the tape may allow the tape to be moved in both directions (i.e. "pushed" and "pulled"). In other words, the axial force may be transmitted in both directions along the metal tape.

When a tape is used, one of its ends may be connected (or coupled) to the tilt controller in the first rail (either directly or with an intermediate coupling which transfers the tape movement to the tilt controller), The other end of the tape may be connected (or coupled) to the actuator in the second rail (again either directly to the actuator or with an intermediate coupling mechanism which transfers movement of the actuator to the tape). Actuator movement will be transferred to the tilt controller in a relatively straightforward push-pull manner due to the stiffness of the tape in the axial direction.

When such a tape is used, the excess length of the tape caused by different degrees of extension/retraction of the blind, needs to be dealt with. In other words, the operating length of the tape needs to be adjusted in accordance with the degree of extension or retraction of the blind. It is envisaged that, when such a tape is used and the blind is raised, the tape may be allowed to be inserted into the bottom (second) rail as the blind is raised and emerge from it when the rail is lowered. This may put constraints on height and width of the blind. Alternatively, the tape may be rolled up when the blind is raised thus shortening its effective length. When lowering the blind the tape may be unrolled, paying out length as the blind is lowered.

In an arrangement using such a tape, a gripping mechanism may be used which grips the tape when the control actuator is manipulated to hold the tape and to transfer movement of the control actuator to the tape in a push-pull manner. For example, when the control actuator is moved to the left, it grips the tape and pulls the tape, which pull transfers to a pull on the tilt controller, thus moving the tilt controller. Note that when the movement is reversed, the controller will push the tape and it will transfer the push to the tilt controller.

When a single cord is used, rather than a tape, there is no push-pull action (due to the cord not having sufficient axial rigidity). In order to allow tilting in both directions, a spring may be provided which biases the tilting mechanism (tilt controller) in one direction. In such an arrangement a brake is needed to keep a selected tilt angle from being left under the influence of the biasing spring. Thus when, for example, only cord 107 is present in the arrangement of FIGS. 2A, 2B and 2C, and cord 112 is not present, a spring may be used in the first rail 108 biasing the tilt controller 101 in a preferred direction, e.g. to the left when looking at the drawing FIGS. 2A, 2B and 2C. Upon manipulation of the actuator 102 to the right as described above, the tilt controller 101 is pulled to the left against the biasing force. In order to maintain the tilt controller in the desired position (i.e. to prevent the tilt controller from slipping back towards the biasing direction), a brake may be provided in the actuator, locking it and the transfer cord 107 in place. When it is desired to have motion in the opposite direction, the brake may be released by the user. This release causes the tilt controller 101 to be moved back by the spring to its 'biased position' e.g. the right when looking at FIGS. 2A, 2B and 2C, which will cause the pivot point 110 to pull a bigger loop from cord 106, and this will cause the actuator 102 to move back to the left. Thus, the tilting of the blind can be controlled in both directions with a single cord 112.

Figure 6:
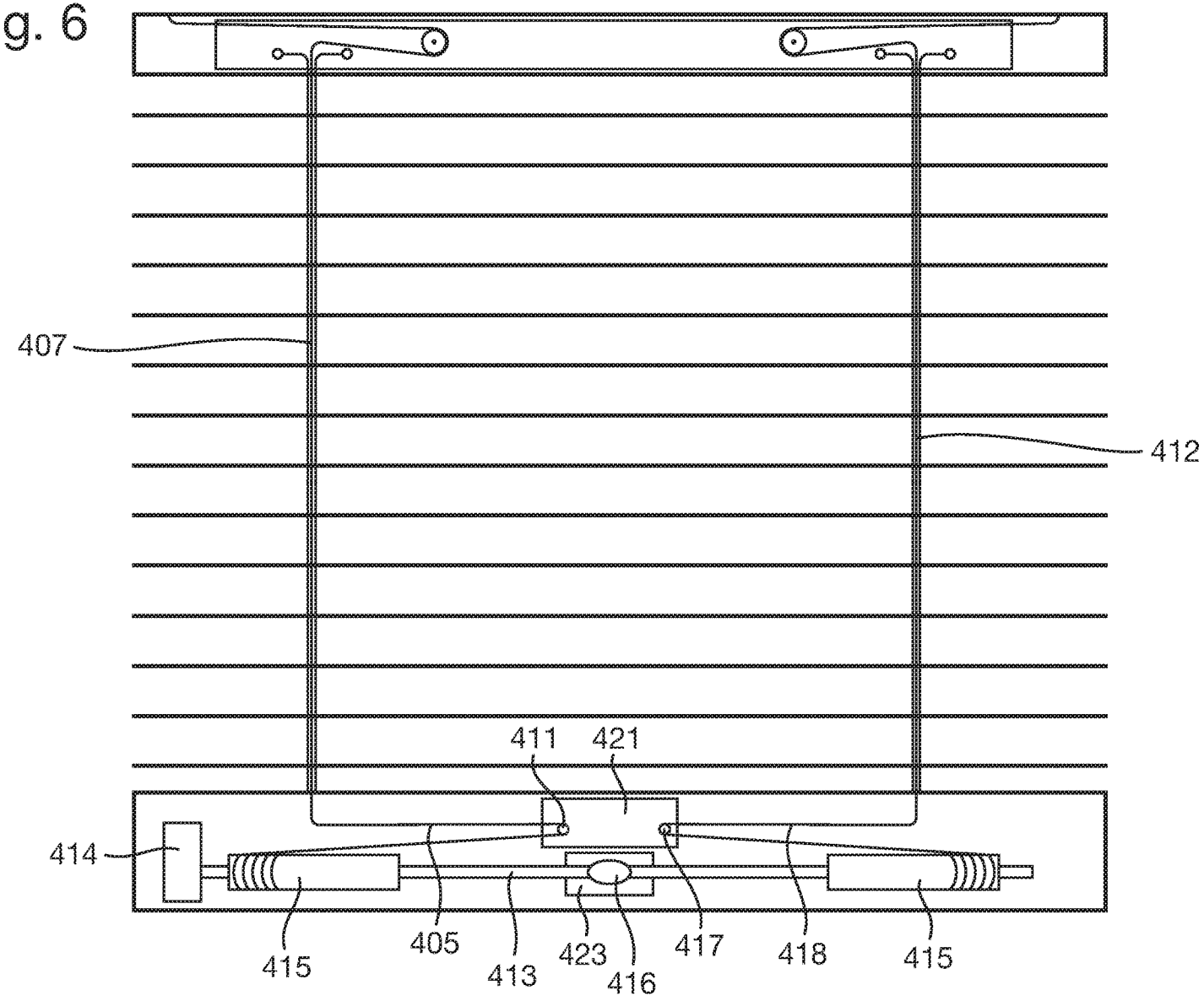
FIG. 6 illustrates a Venetian blind with a free-hanging rail and a transfer mechanism.

When a cord is used in the transfer mechanism, a solution preventing slack in the cord by caused by different degrees of extension/retraction of the blind, needs to be found. In the example of FIGS. 2A, 2B, 2C and 3, the cord may be constrained by being fixed at its top and bottom ends to a stationary surface, e.g. a window frame or door frame. In another solution the cord may be constrained in the bottom rail, as is shown in FIG. 6. These solutions are explained below.

In an arrangement, the first transfer cord includes a first loop that extends around a first pivot point in the tilt controller; a second loop that extends around a second pivot point in the control actuator; and the ends of the first transfer cord are constrained such that movement of the second pivot point against the second loop enlarges the length of the second loop, which pulls transfer cord from the first loop, shortening the length of the first loop such that the first pivot point is moved.

In the arrangement shown in FIGS. 2-5, a first end of the first transfer cord 107 is anchored to a first anchor point 118, and extends from the first anchor point to a first end of the first rail 108. The first transfer cord then extends from the first end of the first rail to a first pivot point 110, around the pivot point 110 and back to the first end of the first rail, before joining a first intermediate portion 106, thus forming a first loop 104 around the first pivot point 110. Likewise, a second end of the first transfer cord 107 is anchored to a second anchor point 119 and extends from the second anchor point 119 to a first end of the second rail 109. The first transfer cord then extends from the first end of a second rail 109, around a second pivot point 111, and back to the first end of the second rail 109, thus forming a second loop 105 around the second pivot point 111, which then joins the first intermediate portion 106. That is, both ends of the first transfer cord 107 are anchored to a fixed point (e.g. on the architectural frame), with the first and second loops between the anchor points, either side of the first intermediate portion 106. In other words, the two loops are provided either side of the first intermediate portion.

In this arrangement, the first intermediate portion 106 acts as the transfer portion described above. In other words, it is the first intermediate portion 106 that extends between the first and second rails, and moves to transmit movement.

The pivot points may be a guide portion, such as a pin or a disc, around which the cord extends to make a bend in the cord. The portions of cord either side of the pivot points need not be parallel. The pivot point may also be rotatable, like a pulley. The pivot point provides a point around which the cord wraps, and the cord can slide relative to the pivot point. That is, when the size of the loops becomes bigger or smaller due to the movement of the control actuator, the cord slides around the pivot point such that the length of the loop changes.

Thus, when the control actuator 102 is moved, the second pivot point 111 pulls the second loop 105, increasing the length of the second loop 105. In turn, this causes the length of the first loop 104 to shorten, which has the effect of pulling on the first pivot point 110, and thus moving the tilt controller 101.

Thus, if the control actuator 102 is moved to the right in FIG. 2A, the tilt controller 101 will move to the left. That is, the control actuator 102 is moved away from the left end of the second rail 109, which causes the tilt controller 101 to move towards the left end of the first rail 108. This movement will cause one of the front and rear tilt cords 126, 127 to lengthen and the other of the tilt cords 126, 127 to shorten, resulting in tilting of the slats 125.

It will be understood that, when the second loop 105 is lengthened, some of the cord which previously formed part of the first intermediate portion 106 slides relative to the second pivot point 111 and is pulled into the second loop 105. Likewise, when the first loop 104 is shortened, some of the cord which previously formed part of the second loop slides relative to the first pivot point 110 is pulled into the first intermediate portion 106. Further, when the first and/or second rails move up or down, the position of the loops 104, 105 relative to the fixed position of the cord move, but this does not affect the length of the loops. Thus, the first intermediate portion and the first and second loops are not fixed portions on the cord, but move depending on the positions of the control actuator, the tilt controller and the two rails.

It will be appreciated that the loops in the drawings are not to scale, nor is their relation to each other to scale. The change of the size of the loops is related to the span of movement of the tilt control actuator, which will be sized in relation to the desired maximum lengthening and shortening of the tilt cords (shown as 126, 127 in FIGS. 2A and 3) necessary to effect a full range of tilting the slats (shown as 125 in FIGS. 2A and 3). A full tilt range for a typical slat is from a first (forward) vertical position (e.g. a top surface of the slat facing front) via horizontal (e.g. the top surface of the slat facing upwards) to a second (backwards) vertical (e.g. the top surface of the slat facing rear); this generally encompasses 180 degrees or less. The front to back width of the slats will also affect the amount of lengthening/shortening necessary to be able to effectuate a full range of tilting. A narrow slat will need less lengthening/shortening to realize a certain tilt angle than a broader slat.

The transfer cord need not extend to the ends of the respective rails from the pivot points. The transfer cord may pass through an opening in the first rail before extending to the second rail, and through another opening in the second rail. The openings may be at any suitable position on the rails.

In an arrangement, the transfer mechanism may include a second transfer cord, configured such that the movement of the control actuator moves at least a part of the second transfer cord, which in turn moves the tilt controller. The second transfer cord may include a third loop that extends around a third pivot point in the tilt controller; a fourth loop that extends around a fourth pivot point in the control actuator; wherein the ends of the second transfer cord are constrained such that movement of the fourth pivot point against the fourth loop enlarges the length of the fourth loop, which pulls transfer cord from the third loop, shortening the length of the third loop such that the third pivot point is moved.

Use of such an arrangement in conjunction with the first transfer cord provides a convenient arrangement that enables transfer of movement from the control actuator to the tilt controller for movement in two opposite directions without the need for biasing mechanisms and/or brakes.

In the arrangement shown in FIGS. 2A, 2B and 2C, a first end of the second transfer cord 112 is anchored to a third anchor point 120, and extends from the third anchor point to a second end of the first rail 108. The second transfer cord 112 then extends from the second end of the first rail to a third pivot point 116, around the third pivot point 116 and back to the second end of the first rail, before joining a second intermediate portion 115, thus forming a third loop 113 around the third pivot point 116. Likewise, a second end of the second transfer cord 112 is anchored to a fourth anchor point 121 and extends from the fourth anchor point 121 to a second end of the second rail 109. The second transfer cord 112 then extends from the second end of the second rail 109, around a fourth pivot point 117, and back to the second end of the second rail 109, thus forming a fourth loop 114 around the fourth pivot point 117, which then joins the second intermediate portion 115. The second intermediate portion 115 extends between the third loop 113 and the fourth loop 114. That is, both ends of the second transfer cord 112 are anchored to a fixed point (e.g. on the architectural frame), with the third and fourth loops between the anchor points, either side of the second intermediate portion 115.

In this arrangement, the second intermediate portion 115 acts as a transfer portion as described above.

The second transfer cord works in the same way as the first transfer cord, but moves the tilt controller in the opposite direction. Thus, when the control actuator 102 is moved, the fourth pivot point 117 pulls the fourth loop 114, increasing the length of the fourth loop 114. This movement is transmitted to the third loop 113 via the second intermediate portion 115, which causes the third loop 113 to shorten, which has the effect of pulling on the third pivot point 116, and thus moving the tilt controller 101.

Thus, if the control actuator 102 is moved to the left in FIG. 2A, the tilt controller 101 will move to the right. That is, the control actuator 102 is moved away from the right end of the second rail 109, which causes the tilt controller 101 to move towards the right end of the first rail 108.

Again, as explained above in relation to the first intermediate portion, it will be understood that the second intermediate portion 115 and the third and fourth loops are not fixed portions of the cord, but move depending on the positions of the control actuator, the tilt controller and the two rails.

The above arrangement of first and second transfer cords ensures that the mechanism can move reliably in both directions to allow a full range of blind tilt to be controlled. Due to the configuration of cords with loops, this arrangement allows the "mechanical signal" of movement of the control actuator to be transmitted to the tilt controller regardless of the distance between the first and second rail. As described above, the transfer cords remain taut because their two ends are constrained (anchored). When the rails are moved, each respective pivot point slides along the transfer cord, such that the pivot point moves relative to the cord. The transfer cord always remains taut regardless of the position of the rails, because, in addition to the cords being anchored, the position of the loop on the cord changes when the rails are moved. Thus, because the transfer cords remain taut, movement of the control actuator can always be transferred to movement of the tilt controller.

The control actuator may include a handle configured to operate the control actuator. Where the control actuator includes a slider, the handle may slide along the second rail. Further, any suitable actuator may be used.

In the arrangement shown in FIGS. 2A, 2B and 2C, the control actuator may 102 have a handle 122 positioned outside of the second rail 109 and connected to a slider 124 inside the second rail 109. For example, a slot may be provided in the second rail through which the handle 112 can project allowing the handle to be moved back and forth along the bottom rail. The second and fourth pivot points 111, 117 may be on the slider 124 inside the second rail 109. Thus, the user can slide the handle 122 along the second rail 109, in order to operate the blind tilt controller.

Alternatively, the control actuator 102 may include a rotary knob (not shown), the rotational movement of which is converted into linear motion of the slider as previously described. This may be achieved by the use of a rack and pinion, or any other suitable mechanism.

In an arrangement, at least one end of the first or second transfer cord may be constrained by being anchored to the architectural frame. The cord may be anchored directly to the frame by any suitable method, such as a cord gripper, or may be anchored to the rail, which is in turn anchored to the architectural frame.

Figure 3:
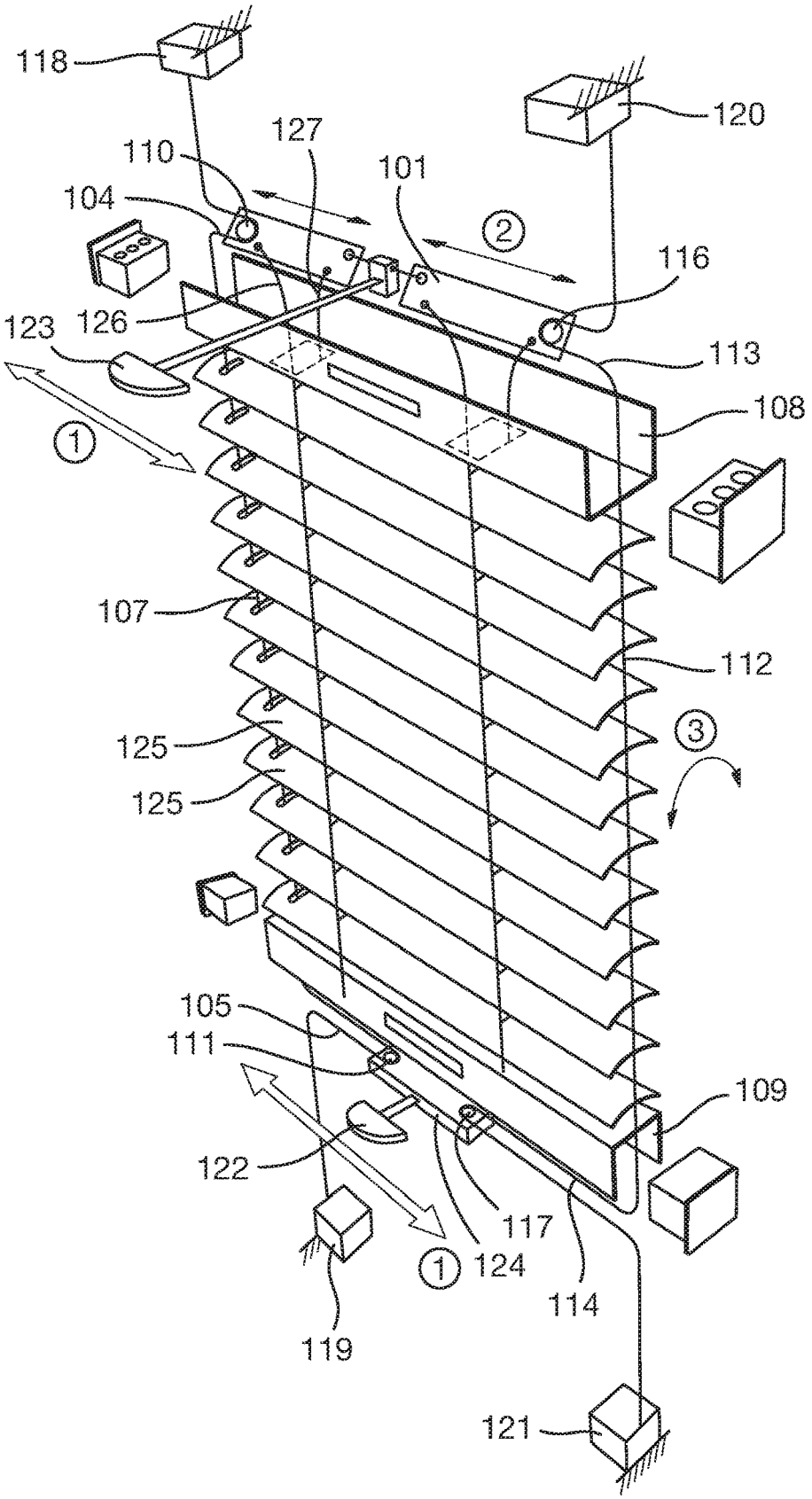
FIG. 3 illustrates a top down bottom up Venetian blind with two transfer cords.
Figure 4:
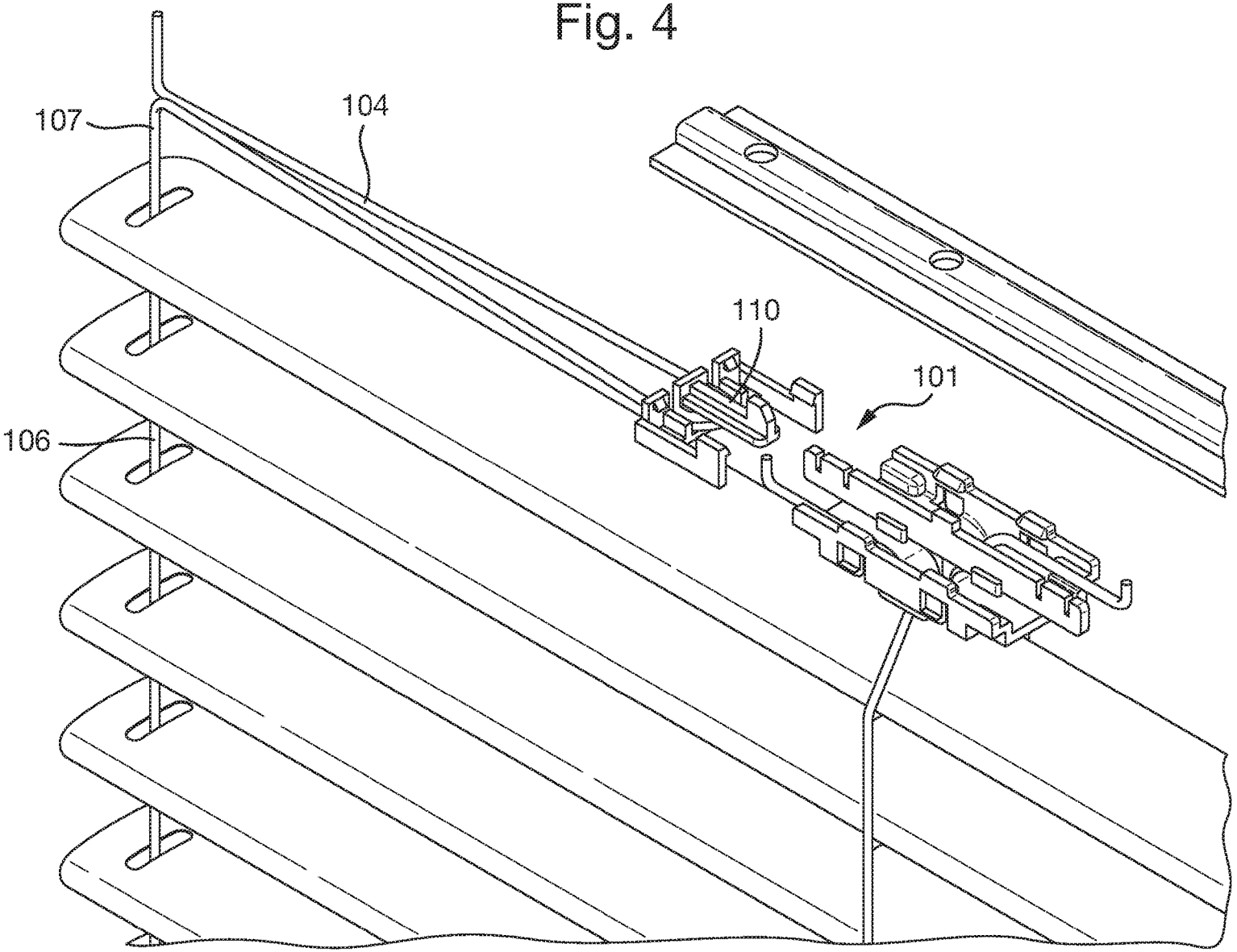
FIG. 4 shows a close up view of part of FIG. 3.
Figure 5:
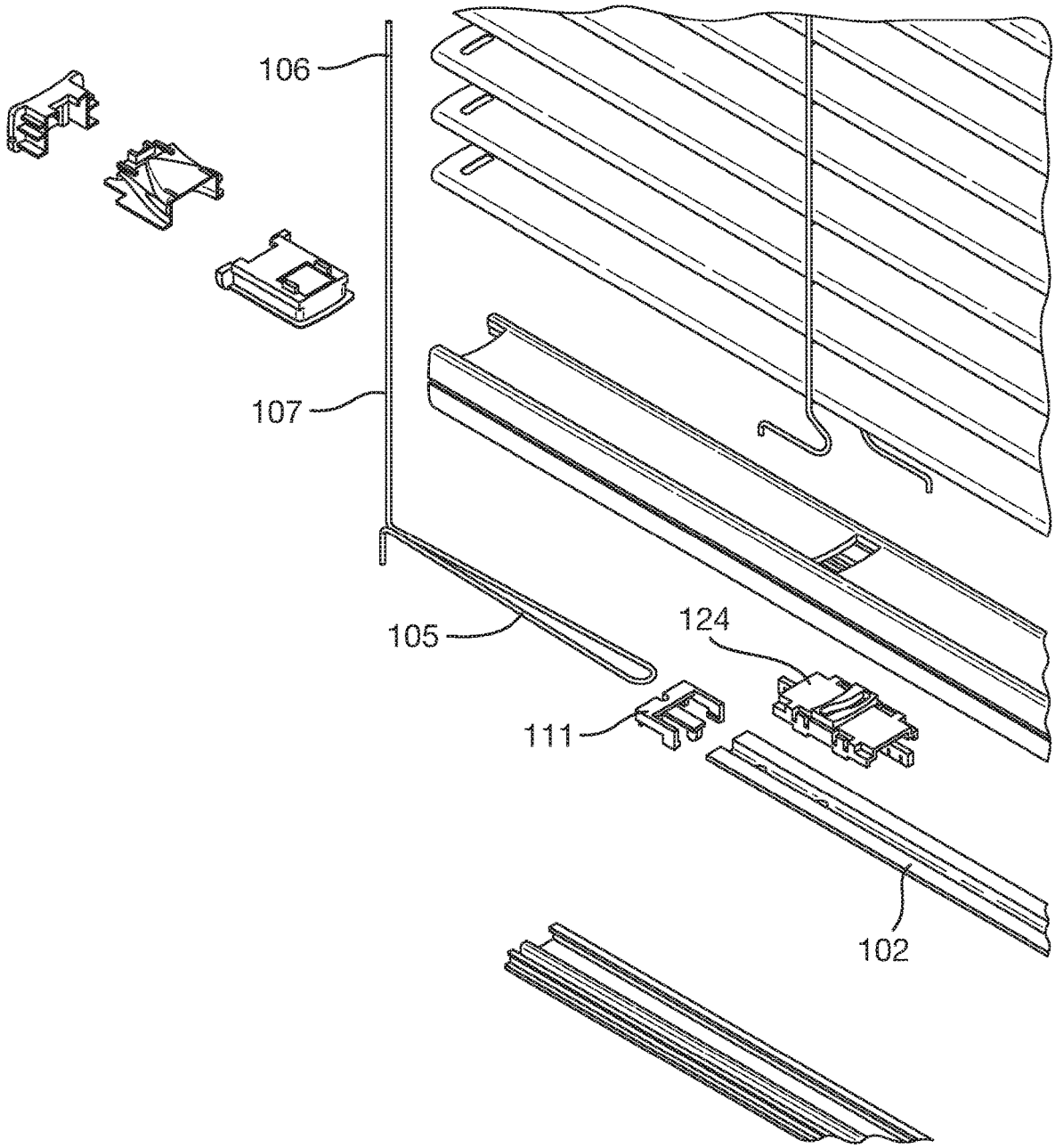
FIG. 5 shows a close up view of part of FIG. 3.

For example, in the arrangement shown in FIG. 3, when the blind is mounted in a vertical configuration, the end of the first loop 104 which is not connected to the first intermediate portion 106 may extend from the first rail 108 to a first anchor point 118 at the top of the architectural opening. Thus, one end of the first transfer cord 107 is constrained. Likewise, the end of the third loop 113 which is not connected to the second intermediate portion 115 may extend from the first rail 108 to a second anchor point 119 at the top of the architectural opening. Thus, one end of the second transfer cord is constrained.

In an arrangement, both ends of each transfer cord may be constrained by being anchored to the architectural frame. The cord may be anchored directly to the frame by any suitable method, such as a cord gripper, or may be anchored to the rail, which is in turn anchored to the architectural frame. In the context of a Venetian blind mounted using tensioning cords, such an arrangement may be convenient for constraining the transfer cords of the transfer mechanism, ensuring that the increase in tension in a cord created by movement of the control actuator is transferred to, and results in movement of, the tilt controller. As discussed above, in such a tensioned Venetian blind, tension cords securing the position of the blind may also be secured to an architectural frame. These may be secured separately from the transfer cords of the transfer mechanism, or may share at least one anchor point.

For example, in the arrangement shown in FIG. 3, when the blind is mounted in a vertical configuration, the end of the second loop 105, which is not connected to the first intermediate portion 106, may extend from the second rail 109 to a third anchor point 120 at the bottom of the architectural opening. Thus, as shown in FIG. 3, both ends of the first transfer cord 107 are constrained by being anchored to the architectural frame. Likewise, the end of the fourth loop 114 which is not connected to the second intermediate portion 115 may extend from the second rail 109 to a fourth anchor point 121 at the bottom of the architectural opening. Thus, as shown in FIG. 3, both ends of the second transfer cord 112 are constrained by being anchored to the architectural frame.

Thus, as shown in FIG. 3, both ends of the first transfer cord 107 and the second transfer cord may extend from respective ends of respective loops after they have passed the respective rails, and be anchored to points on the architectural frame.

In an arrangement, one end of each transfer cord may be constrained on a respective spool in the second rail, each spool being configured such that each transfer cord is wound or unwound around each respective spool when the blind is retracted or extended, namely when the second rail is moved towards or away from the first rail.

For example, in the arrangement shown in FIG. 6, the transfer cords 107 are not of a fixed operating length. The second rail is free hanging, and the transfer cords 407, 412 are attached to respective pivot points 411, 417 on a slider 421 in the second rail. This arrangement is similar to that shown in FIGS. 2-5, but with the ends of the transfer cords constrained on a pair of spools 415 in the second rail.

When the second rail is raised from its fully extended position, the transfer cords 407, 412 would become slack if there were not a mechanism to prevent this. In the arrangement shown in FIG. 6, the transfer cords are prevented from going slack (i.e. are constrained) by a spooling mechanism 422. The spooling mechanism as shown in FIG. 6 includes a rotational shaft 413 driven by a spring motor 414, a pair of cord spools 415 and a brake 416 between the cord spools, with a handle 423 for an operator.

In order to provide for tilting of the blinds, the handle may be attached to the slider 421, such that movement of the handle 423 causes one of the loops 405, 418 to shorten and the other to lengthen, as described above in relation to FIGS. 2A-C. This causes the transfer cords 407, 412 to move and control the tilting mechanism in the top rail.

The operator may manipulate the second rail by using the handle 423 to take the brake off, and move the bar up or down. The handle may have a push button which allows the brake to be taken off. The spring motor 414 causes the shaft 413 to rotate in a direction to wrap the excess cord around the cord spools when the bottom bar is raised. This will make the cords taut again so that movement can be transferred from the control actuator to the tilt controller. When the bottom bar is lowered, e.g. by the operator pulling the bottom bar down, the cords will be pulled off from the spools. This pulling will rotate the spools in the opposite direction. The spring maybe relatively weak so that the action of the user pulling the blind down, will cause the spools and shaft to rotate together. In such an arrangement the spring may be tensioned when the blind is lowered storing energy to spool the cords up when the blind is raised. Thus, in this arrangement, one end of each transfer cord is constrained on a respective spool in the second rail.

In an arrangement, the transfer mechanism may include a first rod extending between the first and second rails; and the transfer mechanism be configured to transfer movement of the control actuator to movement of the tilt controller by rotation of the first rod about its longitudinal axis.

The rod may rotate about its longitudinal axis in order to actuate the tilt controller. In order to allow for the rails of the blind to move relative to each other, the rod may be telescopic so that it lengthens when the blind is extended (i.e. when the rails move away from each other) and shortens when the blind is retracted (i.e. when the rails move towards each other). An arrangement such as bevel gears may be used to transfer movement of the actuator to the rod, and from the rod to a tilt shaft of a tilt controller.

In an arrangement, the transfer mechanism further includes a second rod which extends along the first rail from the tilt controller to a first end of the first rod; and a third rod which extends along the second rail from the control actuator to a second end of the first rod, wherein each of the first, second and third rods are configured to rotate about their respective longitudinal axes, and wherein the first, second and third rods are joined by rotational couplings configured such that rotation of any one rod causes rotation of each other rod to which it is connected.

For example, in an arrangement as shown in FIG. 7, the transfer mechanism may include a first rod 503, a second rod 504 and a third rod 505, with the rods joined by rotational couplings 506, 507.

In this arrangement, the third rod 505 is attached to the control actuator 502, which may include, for example, a tab or lever on the third rod. The control actuator 502 may also include a rotary knob. The user can operate the tab, lever or knob, which causes the third rod 505 to rotate about its longitudinal axis. When the control actuator 502 includes a rotary knob, rotation of the rotary knob may cause rotation of a bevel gear, which meshes with a corresponding bevel gear on the third rod, thus converting rotation of the knob into rotation of the third rod 505 about its longitudinal axis. When a tab or lever is used, the tab or lever may be attached to the third rod, extending from the third rod in a radial direction. A slot may be cut in the bottom rail, allowing movement of the tab or lever circumferentially relative to the rod, causing axial movement of the third rod 505. The control actuator may be configured such that it can rotate the third rod 505 in both axial directions, in order to cause tilting of the blind in both senses (opening and closing the slats).

At the end of the third rod 505, a first rotational coupling 506 couples the second rod 504 to one end of the first rod 503, which has at its other end a second rotational coupling 507. Then, the first rod 503 is coupled to the second rod 504 by the second rotational coupling 507. The second rod 504 is then attached to the tilt controller 501. Thus, rotation of the third rod 505 about its longitudinal axis causes the second rod 504 to rotate about its longitudinal axis and thereby control the tilt controller 501.

As shown in FIG. 7, the first rod 503 is telescopic so that movement can be transferred via the first rod 503 regardless of the relative position of the two rails. In this arrangement, the first rod 503 acts as the transfer portion described above. In other words, it is the first rod 503 that extends between the first and second rails, and moves (i.e. rotates axially) to transmit movement.

As described above, the arrangement described herein may be applied to a tensioned Venetian blind or Venetian blind with a fixed top rail and a free hanging bottom rail.

In general, either one or both of the first and second rails may be moveable. In particular, it will be understood that, in any of the arrangements described herein, one or both of the first rail or second rail may be fixed relative to the architectural frame, or moveable relative to the architectural frame. In an arrangement, the first rail is configured to be fixed relative to the architectural frame. In such an arrangement, the second rail may be configured to be moveable relative to the architectural frame. In another arrangement, the first rail is configured to be moveable relative to the architectural frame. In such an arrangement, the second rail may be configured to be moveable relative to the architectural frame. In any case, the transfer mechanism is able to transfer movement of the control actuator to the movement of the tilt controller, regardless of changes in the separation between the first and second rails.

Figure 10:
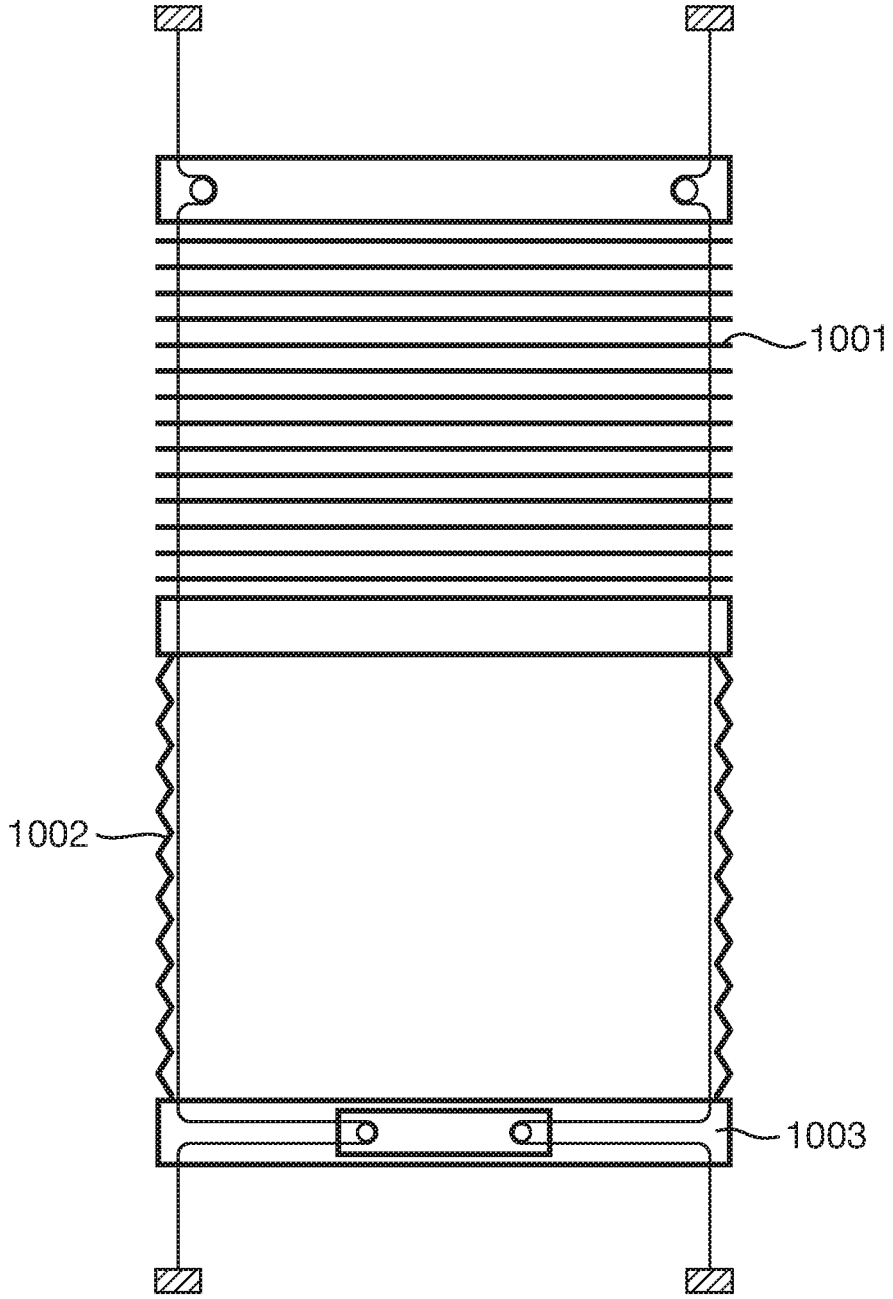
FIG. 10 illustrates an arrangement with a Venetian blind, a pleated blind, and three rails.

The term "first rail" as used herein is used for the rail including the tilt controller, and the term "second rail" is used for the rail of a blind including the control actuator. In arrangements having three or more rails, the second rail is not necessarily the rail immediately below the first rail (i.e. a middle rail), but may also be a bottom rail, regardless of the number of rails. Arrangements including more than one shade, for example including a Venetian blind and a pleated, honeycomb, cellular, or roller blind or other types of blinds, will have more than two rails. In the arrangement shown in FIG. 10, the Venetian blind 1001 is the upper blind and a pleated blind 1002 is the lower blind. In the arrangement of FIG. 10, the second rail 1003 (i.e. the rail including the tilt controller) is the lowest of the three rails. However, the second rail, (i.e. the rail including the tilt controller) may be the middle rail between the Venetian blind and the pleated blind, or any other rail in other arrangements. It will be appreciated that an arrangement which includes a Venetian blind and a second type of blind can be considered itself as a "Venetian blind" as described throughout this application.

The blind tilt controller may include a second control actuator configured to actuate the tilt controller. This provides an additional means of controlling tilt of the blinds.

FIG. 3 depicts an arrangement with such an optional second control actuator provided in the first rail 108. The second control actuator is configured to directly actuate the tilt mechanism. In other words, the second control actuator is an alternative means of controlling tilt of the blind, and is connected such that it can move the tilt controller. The second control actuator may be configured to move the tilt controller directly, namely without requiring the use of a transfer mechanism. Alternatively, a second transfer mechanism may be provided to connect the second control actuator to the tilt controller. Such an arrangement may be used, for example, if the second control actuator is located at a fixed point on the architectural frame and the tilt controller is located in a movable rail, such as in a variation of the arrangement depicted in FIGS. 2A, 2B and 2C.

As shown in FIG. 3, the second control actuator may be embodied as a second handle 123. Alternatively, the second actuator may be a rotary knob, as described above in relation to the first control actuator. Alternatively, the second control actuator may be any other suitable actuator for controlling the tilt controller 101.

The transfer mechanisms as herein described may be used with any tilt control mechanisms.

Figure 8:
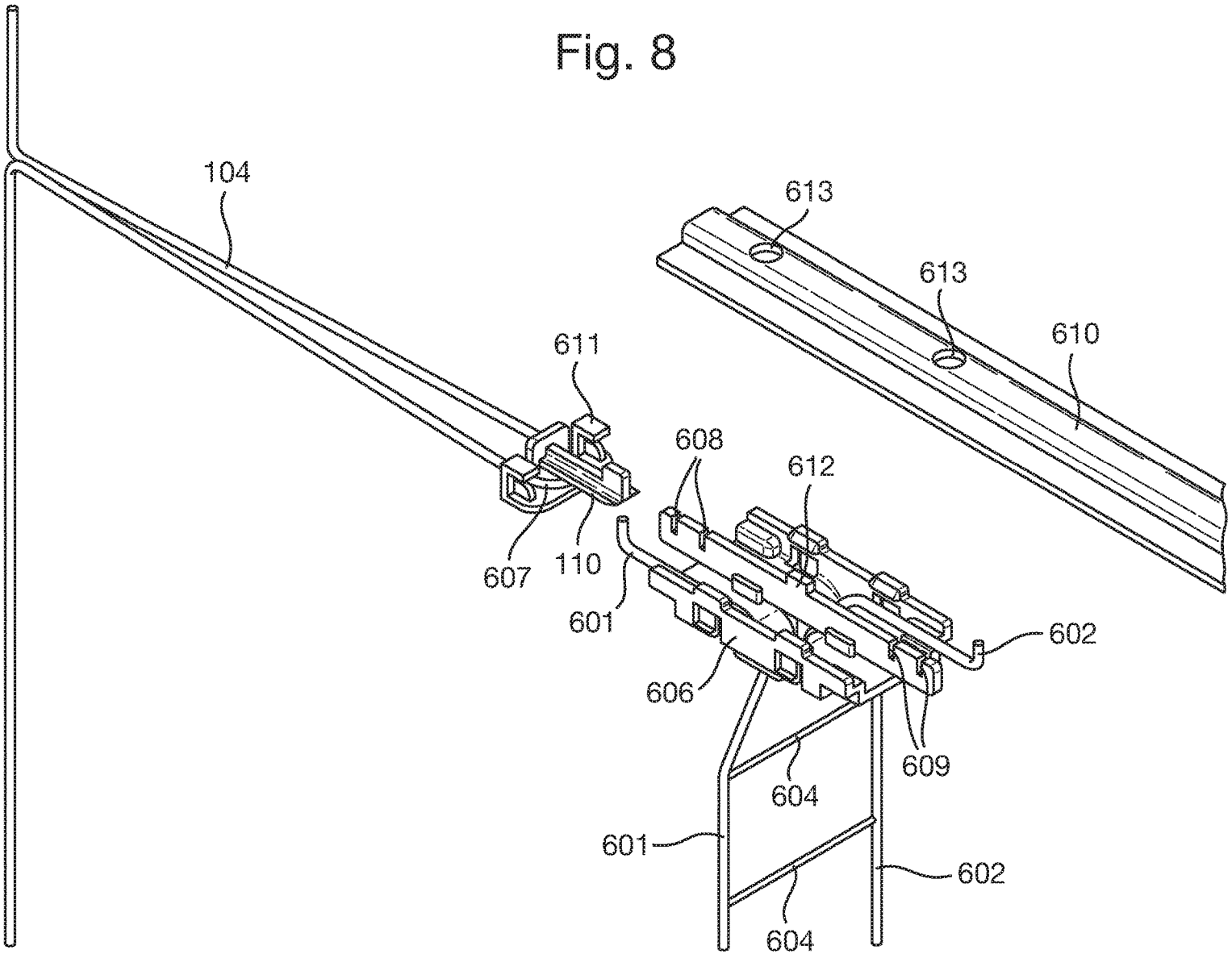
FIG. 8 illustrates an arrangement of a sliding tilt controller.

The tilt controller may, for example, be the sliding tilt controllers that is shown in FIG. 8. In the arrangement shown in FIG. 8, the tilt of the blind may be controlled by first (front) and second (rear) tilt cords 601, 602, which are part of ladder cords 603. Each ladder cord 603 has a plurality of cross member cords (rungs) 604 bridging the first and second tilt cords. The slats can rest on the cross member cords. Alternatively, the slats may be directly connected to the tilt cords with respective front and rear edges. Thus, when the tilt controller pulls one of the tilt cords up and lowers the other tilt cord, the slats tilted. Depending on the degree of movement of the tilt cords the slats are tilted to a bigger degree, e.g. angle. In this manner the slats can be moved from a horizontal or open position to vertical position or closed position.

In the arrangement as shown in FIG. 8, the tilt controller 101 includes a guide 606 for guiding the first tilt cord 601 and the second tilt cord 602 away from the first rail (not shown in FIG. 8). The guide 606 is at a position along the first rail and since a typical slatted blind may have two or more ladder cords, it may have such a guide for each ladder cord. The ladder cords and guides may be spaced apart conveniently so that the slats are properly supported. A slider 605 is slidably positioned on the guide 606. The first tilt cord 601 is attached to a first portion of the slider 605 by weaving it back and forth through slots 608 on a first side of the guide 606. The second tilt cord 602 is attached to a second portion of the slider 605 by weaving it back and forth through slots 609 on a second side of the guide 606 opposite the first side. By the term attached, it is meant that the cord is coupled to the slider in a manner which prevents it from falling off when the blind is operated. Other manners of attaching the cord ends to the slider are also possible, for example the slider may be provided with through openings and the cord may be threaded through such an opening and knotted to prevent slipping back through. When the tilt cords are attached to the slider, sliding movement of the slider 605 along the guide 606 causes one of the first and second tilt cords 601, 602 to be pulled through the guide 606 along the first rail whilst the other of the first and second tilt cords is fed from the first rail out of the guide 606. This lifting/lowering of the respective tilt cords 601, 602 will cause the slats to tilt.

In the arrangement shown in FIG. 8, the first loop 104 passes around the first pivot point 110 in an attachment portion 607 which is attached to the slider 605 by means of a connector plate 610. The attachment portion 607 includes a upward projection 611 and the slider 605 also includes an upward projection 612. The connector plate 610 includes openings 613 for the upward projections to mate. It is envisaged that the connector plate 610 will span all sliders and attachment portions for a blind. As explained above, one slider per ladder cord is needed. This means that in case of the use of an arrangement with a single cord in the transfer mechanism, and two ladder cords, the connector plate will connect the pivot point 110 on attachment portion 607 with the slider 605 and with a further (not shown) slider. In an arrangement with two cords, the connector plate will connect the pivot point on the other side of the head rail too, allowing for the back and forth movement. When the first loop 101 is pulled, the slider 605 is then moved, which in turn causes movement of the tilt cords.

Figure 9:
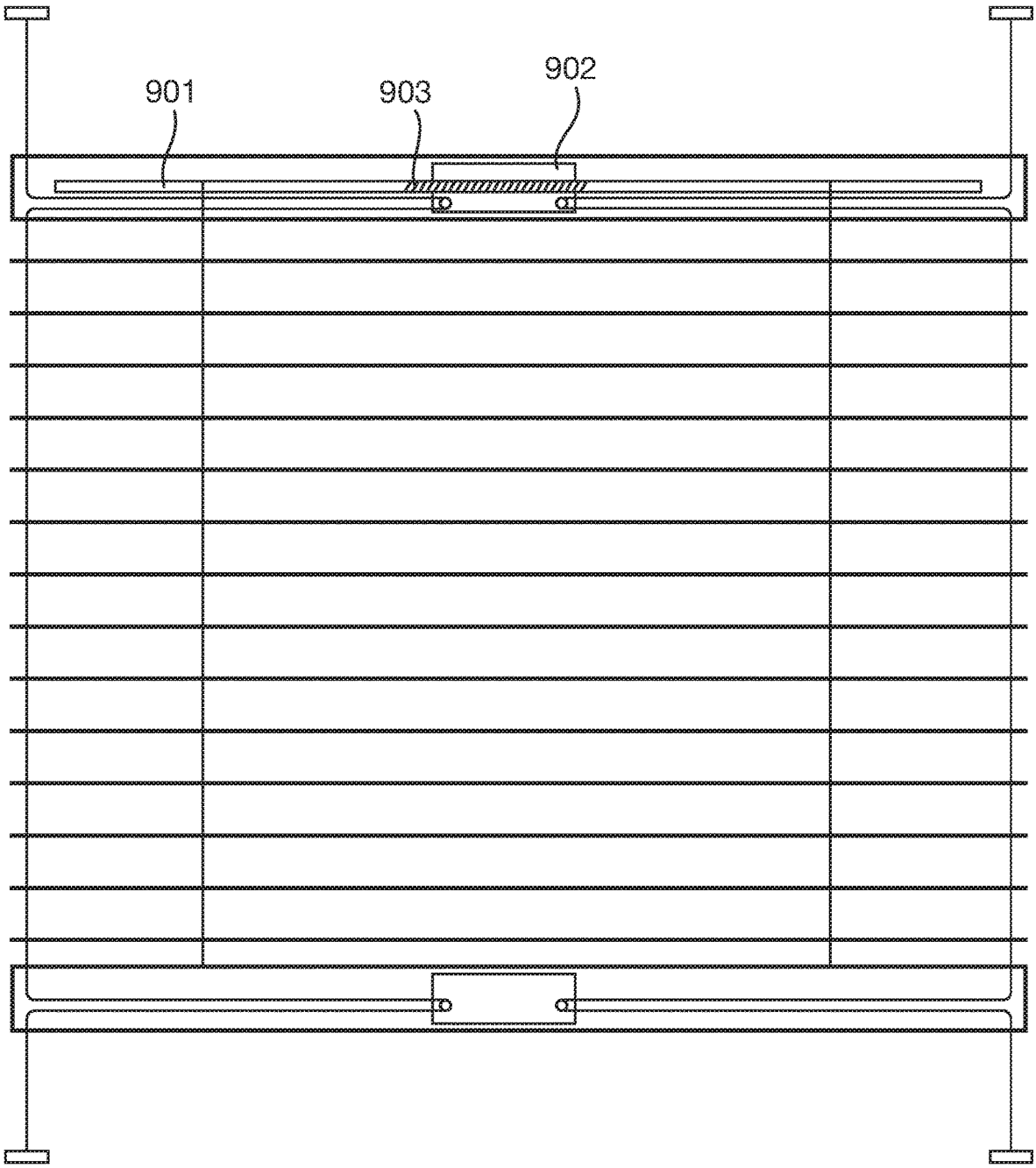
FIG. 9 illustrates an arrangement of a Venetian blind with a tilt controller with a rotatable shaft.

Alternatively, as shown in FIG. 9, the tilt controller may be a mechanism with a central tilt shaft 901 onto which tilt cord drums (not shown) are mounted. The free front and rear ends of the ladder cords are connected to each drum. The tilt shaft has a threaded portion 903, which is actuated by a sliding base 902. The sliding base 902 is actuated by a cord arrangement with four loops, as described above in relation to FIGS. 2-4. The sliding base is operably connected to the threaded portion 903 such that when it slides, the tilt shaft 901 rotates. When the tilt shaft is actuated to rotate over a certain angle, the drums will rotate over the same angle, and the effect is that front or rear tilt cord is lifted while the other of the front/rear cord is lowered, thus causing tilting of the blinds.

These and other features and advantages of the present disclosure will be readily apparent from the detailed description, the scope of the invention being set out in the appended claims.

The present disclosure is set forth in various levels of detail in this application and no limitation as to the scope of the claimed subject matter is intended by either the inclusion or non-inclusion of elements, components, or the like in the summary. In certain instances, details that are not necessary for an understanding of the disclosure or that render other details difficult to perceive may have been omitted. It should be understood that the claimed subject matter is not necessarily limited to the particular embodiments or arrangements illustrated herein.

The accompanying drawings are provided for purposes of illustration only, and the dimensions, positions, order, and relative sizes reflected in the drawings attached hereto may vary. The detailed description will be better understood in conjunction with the accompanying drawings, with reference made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. Thus, it is intended that the present subject matter covers such modifications and variations as come within the scope of the appended claims and their equivalents.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure.

The invention claimed is:

1. A Venetian blind to be fitted to an architectural frame, including:

a first rail;

a second rail;

a plurality of slats supported between the first and second rails; and a transfer mechanism, wherein:

the first rail includes a tilt controller configured to control tilting of the plurality of slats;

the second rail includes a control actuator; and the transfer mechanism mechanically couples the control actuator and the tilt controller to transfer movement of the control actuator to the tilt controller.

2. The Venetian blind according to claim 1, wherein the transfer mechanism includes:

a transfer portion extending between the first and second rails, wherein the transfer portion is configured such that movement of at least part of the transfer portion transfers movement of the control actuator to movement of the tilt controller.

3. The Venetian blind according to claim 1, wherein the transfer mechanism includes a first transfer cord, configured such that the movement of the control actuator moves at least a part of the first transfer cord, which in turn moves the tilt controller.

4. The Venetian blind according to claim 3, wherein the first transfer cord includes:

a first loop that extends around a first pivot point in the tilt controller;

a second loop that extends around a second pivot point in the control actuator; and the ends of the first transfer cord are constrained such that movement of the second pivot point against the second loop enlarges the length of the second loop, which pulls transfer cord from the first loop, shortening the length of the first loop such that the first pivot point is moved.

5. The Venetian blind according to claim 3, wherein the transfer mechanism includes a second transfer cord, configured such that the movement of the control actuator moves at least a part of the second transfer cord, which in turn moves the tilt controller.

6. The Venetian blind according to claim 5, wherein the second transfer cord includes:

a third loop that extends around a third pivot point in the tilt controller;

a fourth loop that extends around a fourth pivot point in the control actuator; and wherein the ends of the second transfer cord are constrained such that movement of the fourth pivot point against the fourth loop enlarges the length of the fourth loop, which pulls transfer cord from the third loop, shortening the length of the third loop such that the third pivot point is moved.

7. The Venetian blind according to claim 5, wherein at least one end of the first or second transfer cord is constrained by being anchored to the architectural frame.

8. The Venetian blind according to claim 7, wherein both ends of each transfer cord are constrained by being anchored to the architectural frame.

9. The Venetian blind according to claim 5, wherein one end of each of the first and second transfer cords is constrained on a respective spool in the second rail, each spool configured such that the respective transfer cord is wound or unwound around such spool when the second rail is moved closer to or further from, respectively, the first rail.

10. The Venetian blind according to claim 1, wherein the transfer mechanism includes a first rod extending between the first and second rails; and the transfer mechanism is to transfer movement of the control actuator to movement of the tilt controller by rotation of the first rod about its longitudinal axis.

11. The Venetian blind according to claim 10, wherein the first rod is telescopic.

12. The Venetian blind according to claim 10, wherein the transfer mechanism further includes:

a second rod which extends along the first rail from the tilt controller to a first end of the first rod; and a third rod which extends along the second rail from the control actuator to a second end of the first rod, wherein:

each of the first, second and third rods are configured to rotate about their respective longitudinal axes, and wherein the first, second and third rods are joined by rotational couplings configured such that rotation of any one rod causes rotation of each other rod to which it is connected.

13. The Venetian blind according to claim 1, further including a second control actuator configured to be located in the first rail and configured to actuate the tilt controller.

14. The Venetian blind according to claim 13, wherein the second control actuator is located in the first rail.

15. The Venetian blind according to claim 1, wherein the Venetian blind is configured such that the separation of the first and second rails can be adjusted.

16. A Venetian blind to be fitted to an architectural frame, including:

a first rail;

a second rail; and a transfer mechanism, wherein:

the first rail includes a tilt controller configured to control tilting of the blind;

the second rail includes a control actuator;

the transfer mechanism mechanically couples the control actuator and the tilt controller to transfer movement of the control actuator to the tilt controller; and the blind further includes a second control actuator configured to be located in the first rail and configured to actuate the tilt controller.

17. The Venetian blind according to claim 16, wherein the second control actuator is located in the first rail.

18. A Venetian blind to be fitted to an architectural frame, including:

a first rail;

a second rail; and a transfer mechanism, wherein:

the first rail includes a tilt controller configured to control tilting of the blind;

the second rail includes a control actuator;

the transfer mechanism mechanically couples the control actuator and the tilt controller to transfer movement of the control actuator to the tilt controller;

the transfer mechanism includes a first transfer cord, configured such that the movement of the control actuator moves at least a part of the first transfer cord, which in turn moves the tilt controller; and the first transfer cord includes:

a first loop that extends around a first pivot point in the tilt controller;

a second loop that extends around a second pivot point in the control actuator; and the ends of the first transfer cord are constrained such that movement of the second pivot point against the second loop enlarges the length of the second loop, which pulls transfer cord from the first loop, shortening the length of the first loop such that the first pivot point is moved.

19. The Venetian blind according to claim 18, wherein the transfer mechanism includes a second transfer cord, configured such that the movement of the control actuator moves at least a part of the second transfer cord, which in turn moves the tilt controller.

20. The Venetian blind according to claim 19, wherein the second transfer cord includes:

a third loop that extends around a third pivot point in the tilt controller;

a fourth loop that extends around a fourth pivot point in the control actuator; and wherein the ends of the second transfer cord are constrained such that movement of the fourth pivot point against the fourth loop enlarges the length of the fourth loop, which pulls transfer cord from the third loop, shortening the length of the third loop such that the third pivot point is moved.

* * * * *